US009657608B2

(12) United States Patent
Sugano et al.

(10) Patent No.: US 9,657,608 B2
(45) Date of Patent: May 23, 2017

(54) VARIABLE VALVE TIMING DEVICE AND METHOD OF ASSEMBLING SAME

(71) Applicant: MIKUNI CORPORATION, Tokyo (JP)

(72) Inventors: Koji Sugano, Kanagawa (JP); Ryo Nakanishi, Kanagawa (JP)

(73) Assignee: MIKUNI CORPORATION, Tokyo (JP)

( * ) Notice: Subject to any disclaimer, the term of this patent is extended or adjusted under 35 U.S.C. 154(b) by 0 days.

(21) Appl. No.: 14/761,524

(22) PCT Filed: Jan. 14, 2014

(86) PCT No.: PCT/JP2014/050403
§ 371 (c)(1),
(2) Date: Jul. 16, 2015

(87) PCT Pub. No.: WO2014/112456
PCT Pub. Date: Jul. 24, 2014

(65) Prior Publication Data

US 2015/0361837 A1 Dec. 17, 2015

(30) Foreign Application Priority Data

Jan. 18, 2013 (JP) ..... 2013-007645

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/34469* (2013.01);
(Continued)

(58) Field of Classification Search
CPC ..... F01L 1/3442; F01L 2001/34426; F01L 2001/3443; F01L 2001/34459;
(Continued)

(56) References Cited

U.S. PATENT DOCUMENTS 7,444,970 B2 11/2008 Ogawa
2005/0115527 A1* 6/2005 Kinugawa ..... F01L 1/3442 123/90.17

(Continued)

FOREIGN PATENT DOCUMENTS

CN 1886577 12/2006
CN 101031703 9/2007

(Continued)

OTHER PUBLICATIONS

International Search Report issued Mar. 4, 2014 in International Application No. PCT/JP2014/050403.

*Primary Examiner* — Zelalem Eshete
(74) *Attorney, Agent, or Firm* — Wenderoth, Lind & Ponack, L.L.P.

(57) ABSTRACT

A valve timing varying device includes a housing rotor (20) composed of a front side housing member (22) and a rear side housing member (21), a vane rotor (30), and an urging spring (40) for rotationally urging the vane rotor in one direction with respect to the housing rotor. The urging spring has a coil part, a first end provided outside in a radial direction with respect to the coil part, and a second end provided inside in the radial direction with respect to the coil part. The front side housing member has a first latching concave part for latching the first end on an inside wall face. The vane rotor has an accommodation concave part for accommodating at least a part of the coil part at the front end side, and a second latching concave part for latching the second end in an area facing an opening.

9 Claims, 10 Drawing Sheets

(52) U.S. Cl.
CPC . *F01L 2001/34483* (2013.01); *F01L 2103/00* (2013.01); *Y10T 29/493* (2015.01)

(58) Field of Classification Search
CPC .. F01L 2001/34473; F01L 2001/34453; F02D 13/0219; Y02T 10/18
USPC ..... 123/90.17
See application file for complete search history.

(56) References Cited

U.S. PATENT DOCUMENTS

| | | | | |
|---|---|---|---|---|
| 2005/0252468 | A1* | 11/2005 | Tanaka ..... | F01L 1/022 123/90.17 |
| 2007/0095199 | A1 | 5/2007 | Ogawa et al. | |
| 2007/0266970 | A1 | 11/2007 | Ogawa | |
| 2011/0232595 | A1 | 9/2011 | Kokubo et al. | |

FOREIGN PATENT DOCUMENTS

| | | |
|---|---|---|
| CN | 102200040 | 9/2011 |
| EP | 1 703 087 | 9/2006 |
| EP | 1 795 715 | 6/2007 |
| EP | 2 372 118 | 10/2011 |
| JP | 2005-180378 | 7/2005 |
| JP | 2006-97492 | 4/2006 |
| JP | 2009-180148 | 8/2009 |
| JP | 2009-185766 | 8/2009 |
| JP | 2011-208498 | 10/2011 |
| WO | 2005/061859 | 7/2005 |
| WO | 2006/035602 | 4/2006 |

* cited by examiner

VARIABLE VALVE TIMING DEVICE AND METHOD OF ASSEMBLING SAME

TECHNICAL FIELD

The present invention relates to a valve timing varying device which varies an opening and closing timing (valve timing) of an intake valve or an exhaust valve of an internal combustion engine in response to driving conditions, and a method of assembling thereof.

BACKGROUND ART

As a conventional valve timing varying device, there is known a valve timing varying device including a housing rotor (a driving-side rotor) rotated in synchronism with a crankshaft, a vane rotor (a driven-side rotor) rotated in synchronism with a camshaft and accommodated in the housing rotor to divide an accommodating chamber thereof into a retarded angle chamber and an advanced angle chamber and relatively rotatable relative to the housing rotor within a predetermined operating angle (an angle range between a most advanced angle position and a most retarded angle position), a coiled torsion spring installed between the housing rotor and the vane rotor in order to rotation-urge the vane rotor toward an advanced side, a lock mechanism (a lock piece and a spring) for locking the vane rotor in a predetermined position relative to the housing rotor when stopping and starting the engine and for releasing the lock by an oil pressure, and the like (see Patent document 1).

In the device, the housing rotor has a three-divided structure which consists of a cylindrical member covering an outer peripheral area of the vane rotor, a rear side cover member joined with a rear side of the cylindrical member, and a front side cover member joined with a front side of the cylindrical member. Therefore, the number of parts is increased, the man-hour for assembling is increased, and it causes an increase in cost.

Further, the torsion spring is disposed in an accommodating space formed between the vane rotor and the housing rotor in an interior of the device, one end of the torsion spring is latched (or hooked) on the vane rotor and another end of the torsion spring is latched (or hooked) on the housing rotor. Therefore, upon assembling of the device, in case that the front side member is fastened to the cylindrical member while sandwiching the torsion spring between the vane rotor and the front side cover member, (the one end and the another end of) the torsion spring is not visible. Therefore, it is not easy to assemble the front side cover member to the cylindrical member while latching the one end of the torsion spring on the vane rotor and latching the another end of the torsion spring on the housing rotor (the front side cover member). Furthermore, in case that a two-divided structure that the cylindrical member and the front side cover member are integrally formed is adopted for simplification of the structure, it is more difficult to assemble the torsion spring.

And, as another conventional variable valve timing device, there is known a variable valve timing device including a housing rotor (a housing) rotated in synchronism with a crankshaft, a vane rotor rotated in synchronism with a camshaft and accommodated in the housing rotor to divide an accommodating chamber thereof into a retarded angle chamber and an advanced angle chamber and relatively rotatable relative to the housing rotor within a predetermined operating angle (an angle range between a most advanced angle position and a most retarded angle position), a torsional coiled assist spring for rotation-urging the vane rotor toward an advanced side, a cylindrical bushing for holding the assist spring, a lock mechanism (a lock pin and a spring) for locking the vane rotor in the most advanced angle position relative to the housing rotor when stopping and starting the engine and for releasing the lock by an oil pressure, and the like (see Patent documents 2 and 3).

In the device, the housing rotor has a two-divided structure consisting of a bottomed cylindrical front housing member that accommodates the vane rotor, and a plat-like rear side housing member that is joined with the front side housing member so as to cover a rear side opening of the front side housing member. Therefore, simplification of the structure in the housing rotor can be accomplished. On the other hand, the assist spring is assembled in a manner that the coil part (winding portion) is accommodated in the interior of the bushing fitted in the vane rotor thorough the opening of the front housing member, the one end is fitted in a fitting hole of the bushing and a fitting hole of the vane rotor, and the another end is latched on a fixed pin protruding from an outer front face of the housing rotor.

Therefore, even though the assist spring can be assembled while viewing the one end and the another end, a distance from a center of the vane rotor to the another end in a direction of the rotation axis of the camshaft becomes longer since the another end of the assist spring is located in a position where protrudes forwardly from the housing rotor and therefore, an inclination (a deviation) (relative to the rotation axis) of the vane rotor is promoted, the inclination (the deviation) of the vane rotor causes wear of the bearing portion and an increase of a friction force and therefore, a performance deterioration might be caused.

Further, since the fixed pin for latching (or hooking) on the another end of the assist spring is provided on the front face of the outer side of the housing rotor, a size of the device as a whole in the direction of the rotation axis becomes larger, a requirement of downsizing is not met.

Furthermore, since the cylindrical bushing for accommodating the coil part of the assist spring and the fixed pin provided on the housing rotor and the like are required, there arise problems such that components accompanying the assist spring increase, the structure becomes more complex, and the cost becomes higher.

CITED DOCUMENT

Patent Document

Patent Document 1: Japanese Unexamined Patent Publication No. 2011-208498,

Patent Document 2: Japanese Unexamined Patent Publication No. 2009-185766, and

Patent Document 3: Japanese Unexamined Patent Publication No. 2009-180148.

SUMMARY OF THE INVENTION

Problem to be Solved by the Invention

In view of the above-described problem, it is an object of the present invention to provide a valve timing varying device and a method of assembling thereof, by which an inclination of the vane rotor can be prevented, wear and a friction force in a sliding area can be reduced, a predetermined function can be assured, and the assembling can be easily performed while achieving simplification of the structure, reduction of the number of components, downsizing of the device (thinning in the direction of the rotation axis), cost reduction and the like.

Means for Solving Problem

A valve timing varying device according to the present invention varies an opening and closing timing of an intake valve or an exhaust valve driven so as to open and close via a camshaft by controlling an oil pressure in an advanced angle chamber and a retarded angle chamber, and the valve timing varying device includes: a housing rotor rotated on a rotation axis of the camshaft in synchronism with rotation of the crankshaft; a vane rotor rotated integrally with the camshaft and accommodated in an accommodating chamber of the housing rotor so as to relatively rotate within a predetermined angle range to divide the accommodating chamber into the advanced angle chamber and the retarded angle chamber; and a torsional coiled urging spring for urging the vane rotor toward one rotation direction relative to the housing rotor, wherein the housing rotor is composed of a bottomed cylindrical front side housing member having an opening though which a bolt for fastening the vane rotor to the camshaft is inserted from a front side, and a rear side housing member joined with the front side housing member, the urging spring has a coil part, a first end provided outside in a radial direction with respect to the coil part, and a second end provided inside in the radial direction with respect to the coil part, the front side housing member has a first latching concave part for receiving and latching the first end of the urging spring on an inside wall face facing the vane rotor, and the vane rotor has an accommodating concave part for receiving at least a part of the coil part of the urging spring, and a second latching concave part for receiving and latching the second end of the urging spring in an area facing the opening, on a front end side facing an inside wall face of the front side housing member.

According to this configuration, in the configuration that adopts a two-divided structure consisting of the bottomed cylindrical front side housing member and the rear side housing member, upon assembling of the device, the urging spring and the vane rotor are fitted to the front side housing member such that the urging spring is sandwiched while the first end being latched on the first latching concave part of the front side housing member and at least a part of the coil part being fitted in the accommodating concave part, and the second end is latched on the second latching concave part of the vane rotor with being visible through the opening, whereby the urging spring can be easily assembled while being accommodated in the interior of the housing rotor.

Further, since the urging spring is accommodated inside the housing rotor while adopting the two-divided structure as a housing rotor, the distance in the direction of rotation axis of the camshaft from the center of the vane rotor to the first end of the urging spring can be shortened and therefore, an inclination (a deviation) (relative to the rotation axis) of the vane rotor caused by the urging force of the urging spring can be prevented, wear and a friction force in the sliding area of the vane rotor can be reduced, a predetermined function can be assured. Further, the conventional parts such as fixed pins, bushings or the like are not required. Therefore, simplification of the structure, reduction of the number of components, downsizing of the device (thinning in the direction of the rotation axis), cost reduction and the like can be accomplished.

In the above-described configuration, it is possible to adopt a configuration that the front side housing member has an accommodating concave part for accommodating the coil part connected to the first end of the urging spring on the inside wall face facing the vane rotor.

According to this configuration, since the accommodating concave part that accommodates the coil part connected to the first end of the urging spring is provided on the inside wall face of the housing rotor, a deviation (displacement) of the urging spring upon assembling can be prevented, and downsizing of the device (thinning in the direction of the rotation axis) can be accomplished.

In the above-described configuration, it is possible to adopt a configuration that the first end and the second end of the urging spring are formed so as to extend in a direction perpendicular to the rotation axis of the camshaft, and the first latching concave part and the second latching concave part are formed so as to extend in a direction perpendicular to the rotation axis of the camshaft.

According to this configuration, since all of the first end and the second end of the urging spring and the first latching concave part and the second latching concave part are formed so as to extend in the direction perpendicular to the rotation axis of the camshaft, the device can be further thinned and downsized in the direction of the rotation axis as compared with the case formed so as to extend in the direction of rotation axis.

In the above-described configuration, it is possible to adopt a configuration that the second end of the urging spring is formed so as to line up along the first end on a straight line passing across a center of the coil part.

According to this configuration, when the urging spring has been assembled, most balanced assembling condition can be obtained and therefore, an inclination or a falling (deviation) of the urging spring can be prevented.

In the above-described configuration, it is possible to adopt a configuration that the vane rotor has a thorough-hole for passing through a bolt fastened to the camshaft, the accommodating concave part of the vane rotor is formed into an annular groove so as to define an annular convex part around the through-hole, and the second latching concave part is formed into a groove shape by notching a part of the annular convex part and formed into a groove width greater than a wire diameter of the second end of the urging spring in a rotation direction around the rotation axis.

According to this configuration, since the accommodating concave part defining the annular groove is formed around the thorough-hole on a front end side of the vane rotor and the second latching concave part defining the groove is formed by notching a part of the annular convex part defined by the annular groove, the configuration that the urging spring is accommodated and the second end is latched can be obtained only by cutting a part thereof without attaching another component to the vane rotor. Further, since the second latching concave part is formed into the groove width greater than the wire diameter of the second end, the second end of the urging spring can be easily latched on the second latching concave part.

In the above-described configuration, it is possible to adopt a configuration that the device further comprises a lock mechanism that locks the vane rotor at a predetermined position within a predetermined angle range relative to the housing rotor and unlocks the vane rotor (release its lock) by an oil pressure, the lock mechanism includes a lock pin that is reciprocatable in a direction of the rotation axis and held by the vane rotor while being urged so as to protrude from a rear end face of the vane rotor and that can be fitted in a fitting hole formed on an inside wall face of the rear side housing member in the predetermined position.

According to this configuration, since the urging spring is arranged at the front side of the vane rotor and the lock mechanism is arranged at the rear side of the vane rotor in the configuration provided with the lock mechanism including the lock pin held by the vane rotor, the device can be thinned in the direction of the rotation axis and an expected function required of the lock mechanism and the like can be guaranteed.

A method of assembling a valve timing varying device according to the present invention that varies an opening and closing timing of an intake valve or an exhaust valve driven so as to open and close via a camshaft by controlling an oil pressure in an advanced angle chamber and a retarded angle chamber, and that includes: a housing rotor rotated on a rotation axis of the camshaft in synchronism with rotation of the crankshaft; a vane rotor rotated integrally with the camshaft and accommodated in an accommodating chamber of the housing rotor so as to relatively rotate within a predetermined angle range to divide the accommodating chamber into the advanced angle chamber and the retarded angle chamber; and a torsional coiled urging spring for urging the vane rotor toward one rotation direction relative to the housing rotor, the housing rotor being composed of a bottomed cylindrical front side housing member having an opening though which a bolt for fastening the vane rotor to the camshaft is inserted from a front side, and a rear side housing member joined with the front side housing member, wherein the urging spring and the vane rotor are fitted to the front side housing member such that the urging spring is sandwiched while a first end of the urging spring being latched on a first latching concave part formed on an inside wall face of the front side housing member, a predetermined jig is inserted through the opening of the front side housing member, and a second end of the urging spring is latched by using the jig on a second latching concave part formed on a front end side of the vane rotor facing the inside wall face of the front side housing member in an area facing the opening.

According to this configuration, in the configuration that adopts a two-divided structure consisting of the bottomed cylindrical front side housing member and the rear side housing member, upon assembly of the device, the urging spring and the vane rotor are fitted to the front side housing member such that the urging spring is sandwiched while the first end being latched on the first latching concave part of the front side housing member, and the second end is latched on the second latching concave part by use of the jig with being visible through the opening, whereby the urging spring can be easily assembled while being accommodated inside the housing rotor.

In the above-described configuration, it is possible to adopt a configuration that at least a part of a coil part of the urging spring is fitted in an accommodating concave part formed on a front end side of the vane rotor facing the inside wall face of the front side housing member.

According to this configuration, upon assembling each among of the front side housing member, the urging spring, and the vane rotor, the urging spring can be easily accommodated while preventing positional displacement (deviation) of the urging spring.

In the above-described configuration, it is possible to adopt a configuration that the coil part connected to the first end of the urging spring is fitted to an accommodating concave part formed on the inside wall face of the front side housing member facing the vane rotor.

According to this configuration, upon assembling each among of the front side housing member, the urging spring, and the vane rotor, the urging spring can be easily accommodated while preventing positional displacement (deviation) of the urging spring.

Advantageous Effect of the Invention

According to the valve timing varying device having the above-described configuration, an inclination of the vane rotor can be prevented, wear and a friction force in a sliding area can be reduced, a predetermined function can be assured, and the assembling can be easily performed while achieving simplification of the structure, reduction of the number of components, downsizing of the device (thinning in the direction of the rotation axis), cost reduction and the like.

EMBODIMENT OF THE INVENTION

Figure 1:
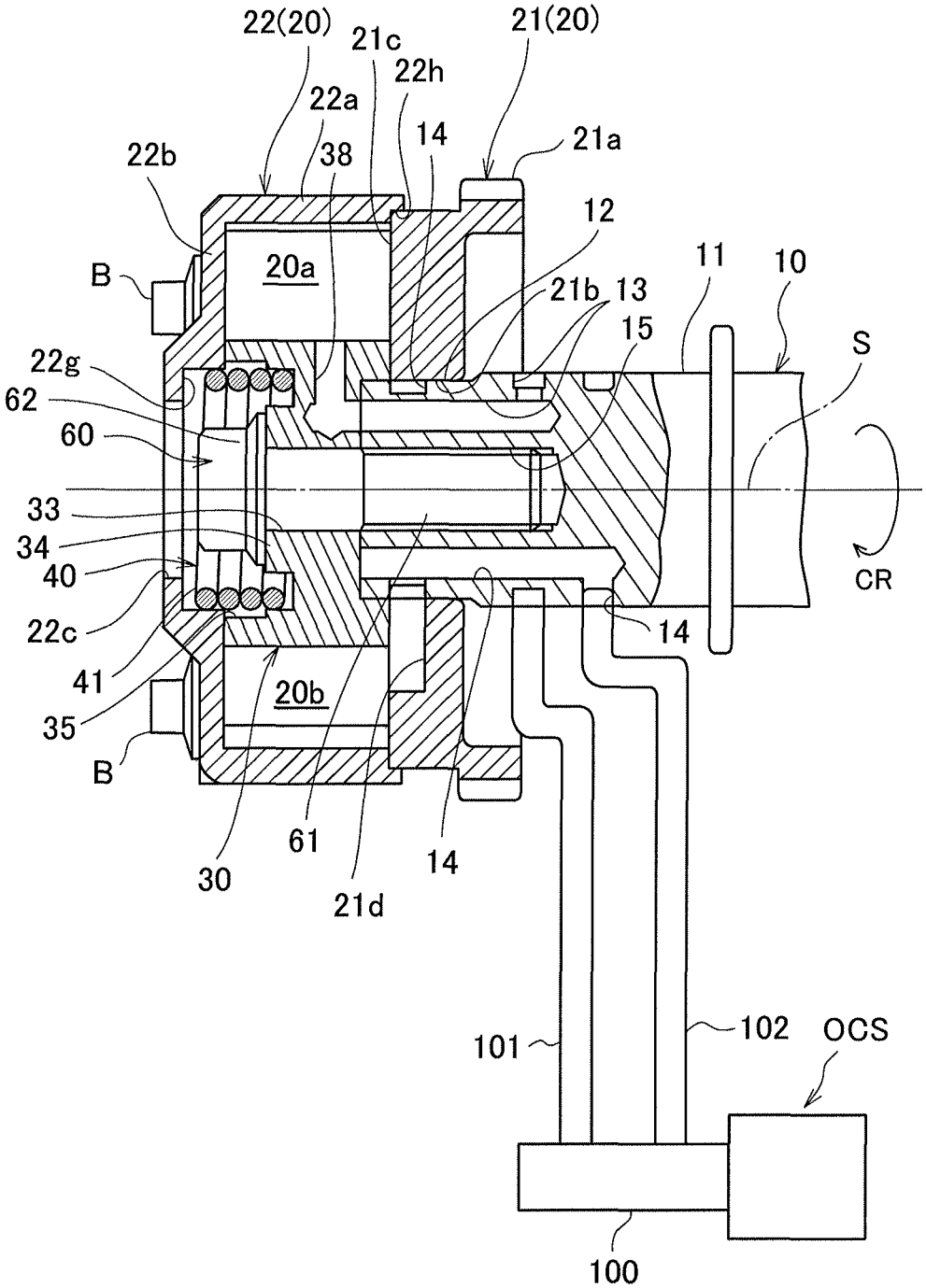
FIG. 1 is a cross sectional view showing a valve timing varying device of the present invention.

Hereinafter, embodiments of the present invention will be described with reference to the attached drawings.

This valve timing varying device includes, as shown in FIG. 1 to FIG. 4, a housing rotor 20 rotated on a rotation axis S of a camshaft 10, a vane rotor 30 detachably fixed to the camshaft 10 so as to be rotated integrally with the camshaft 10 and accommodated in an accommodating chamber of the housing rotor 20 so as to relatively rotate within a predetermined angle range Δθ (see FIG. 10) to divide the accommodating chamber into an advanced angle chamber 20*a* and a retarded angle chamber 20*b*, a torsional coiled urging spring 40 (which has a coil part 41, a first end 42, and a second end 43) for rotation-urging the vane rotor 30 toward one rotation direction (here, toward an advanced angle direction) relative to the housing rotor 20, a lock mechanism 50 for locking the vane rotor 20 with respect to the housing rotor 20 in a predetermined angle position (here, in a most advanced angle position θa) within a predetermined angle range Δθ (angle range between a most advanced angle position θa and a most retarded angle position θr) and unlocking the vane rotor (releasing the lock of the vane rotor) by oil pressure, a bolt 60 for fastening (fixing) the vane rotor 30 to the camshaft 10, a hydraulic control system OCS for controlling a flow of hydraulic oil (lubricating oil), and the like.

In addition, the camshaft 10 is to drive so as to open and close an intake valve or an exhaust valve of an engine by a cam action, the housing rotor 20 is to be synchronized with a rotation of a crankshaft via a chain or the like, thereby transmitting a rotational driving force of the crankshaft to the camshaft 10 via the vane rotor 30.

Figure 2:
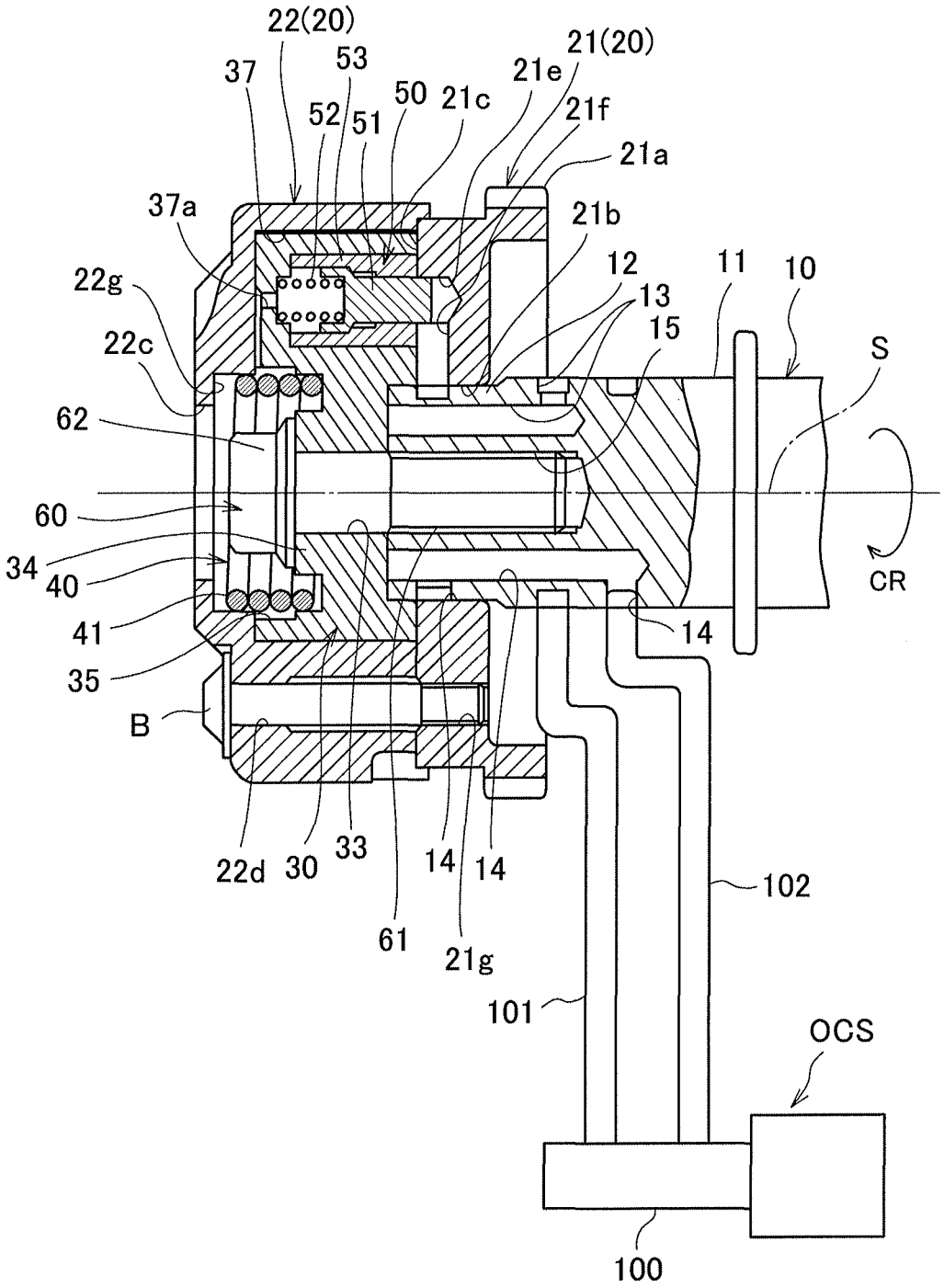
FIG. 2 is a cross sectional view showing the valve timing varying device of the present invention.

The camshaft 10 is, as shown in FIG. 1 and FIG. 2, rotatably supported (so as to rotate toward a direction of arrow CR in FIG. 1 and FIG. 2) about the rotation axis S by bearings (not shown) formed in a cylinder head (not shown) of the engine and has a journal part 11 supported on the bearings, a cylindrical part 12 rotatably supporting the housing rotor 20, an advanced angle passage 13 for supplying and discharging the hydraulic oil, a retarded angle passage 14 for supplying and discharging the hydraulic oil, a female screw part 15 for screwing the bolt 60, and the like.

Figure 3:
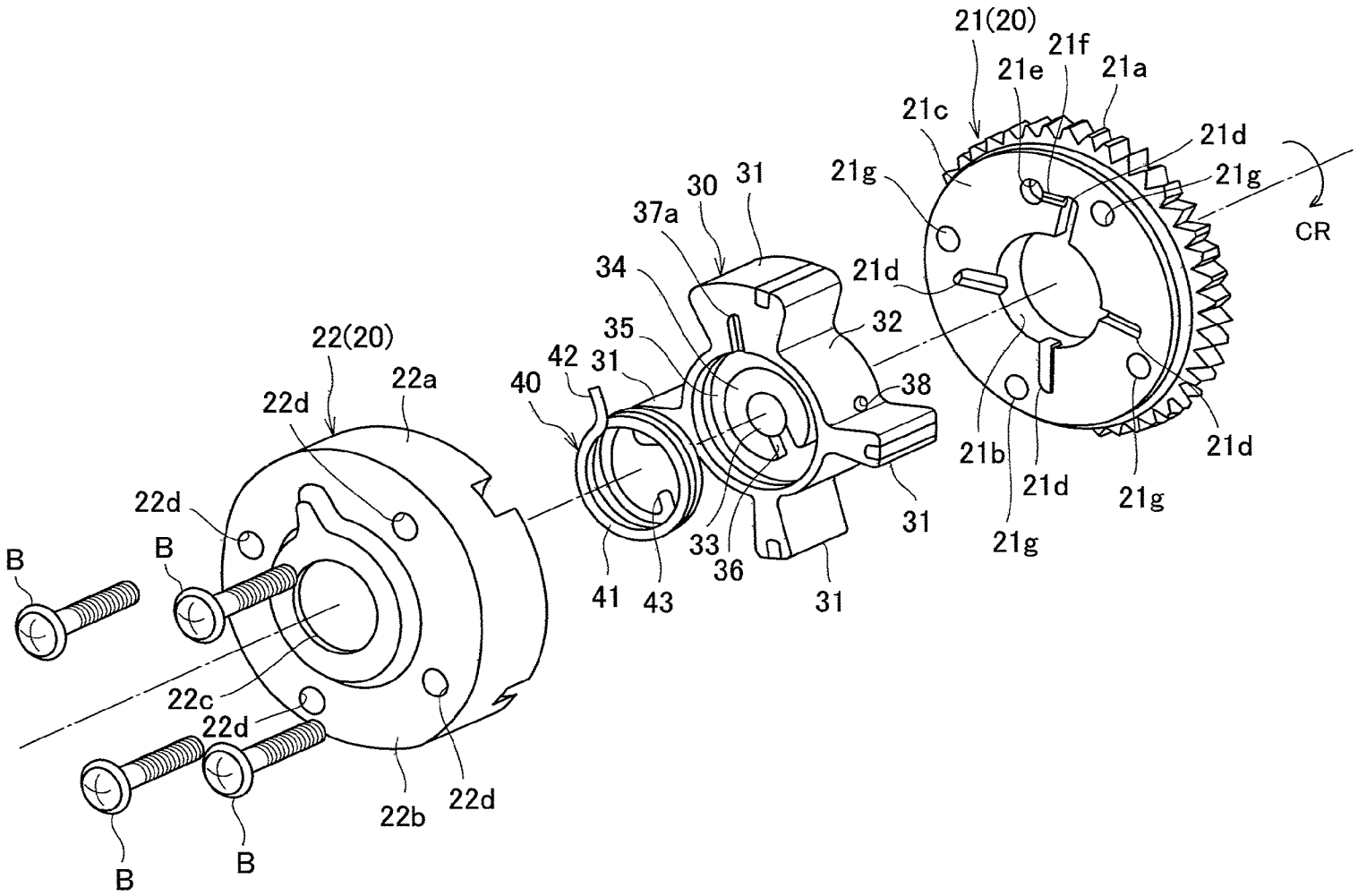
FIG. 3 is an exploded perspective view showing the valve timing varying device of the present invention (viewed from a front side)

The housing rotor 20 is rotatably supported on the rotation axis S of the camshaft 10 while being synchronized with the rotation of the crankshaft, as shown in FIG. 1 to FIG. 3, has a two-divided (two-piece) structure consisting of a substantially disc-shaped rear side housing member 21 and a bottomed cylindrical front side housing member 22 joined with a front face side of the rear side housing member 21, accommodates the vane rotor 30 relatively rotatably within the predetermined angle range Δθ (angle range between the most advanced angle position θa and the most retarded angle position θr) and accommodates the lock mechanism 50, and is formed so as to be divided into an advanced angle chamber 20*a* and a retarded angle chamber 20*b* by (a vane part 31 of) the accommodated vane rotor 30.

The rear side housing member 21 includes, as shown in FIG. 1 to FIG. 3, FIG. 9 and FIG. 10, a sprocket 21*a* as a driven part to which a chain for transmitting the rotational driving force of the crankshaft is wound, an inner circumferential face 21*b* which is rotatably fitted in the cylindrical part 12, a front face (inside wall face) 21*c* with which a back face (rear end face) of the vane rotor 30 comes into slidably contact, a retarded angle passage 21*d* for supplying and discharging the hydraulic oil to and from the retarded angle chamber 20*b*, a fitting hole 21*e* formed on the front face (inside wall face) thereof in order to fit a lock pin 51 included in the lock mechanism 50 thereinto, an oil passage 21*f* for supplying and discharging the hydraulic oil to and from the fitting hole 21*e*, four screw holes 21*g* in each of which a bolt B for fastening the front side housing member 22 is screwed, and the like.

The front side housing member 22 is, as shown in FIG. 1 to FIG. 4, formed into a bottomed cylindrical shape having a cylindrical wall 22*a* and a front wall 22*b*, and includes an opening 22*c* having a center on the rotation axis S in order to pass through the bolt 60, four through-holes 22*d* through which the bolts B are passed respectively, four shoe parts 22*e* which are formed so as to protrude toward the center (the rotation axis S) from the cylindrical wall 22*a* and be equally spaced in a circumferential direction in a side of a back face (inside wall face) of the front wall 22*b*, a first latching concave part 22*f* which is formed on the back face (inside wall face) of the front wall 22*b* and receives to latch the first end 42 of the urging spring 40, an accommodating concave part 22*g* which is formed so as to dent in the rotation axis S in order to accommodate the coil part 41 connected to the first end 42 of the urging spring 40, an annular joint part 22*h* which is fitted into and joined with (an outer circumferential edge area of) the front face 21*c* of the rear side housing member 21, and the like.

Figure 4:
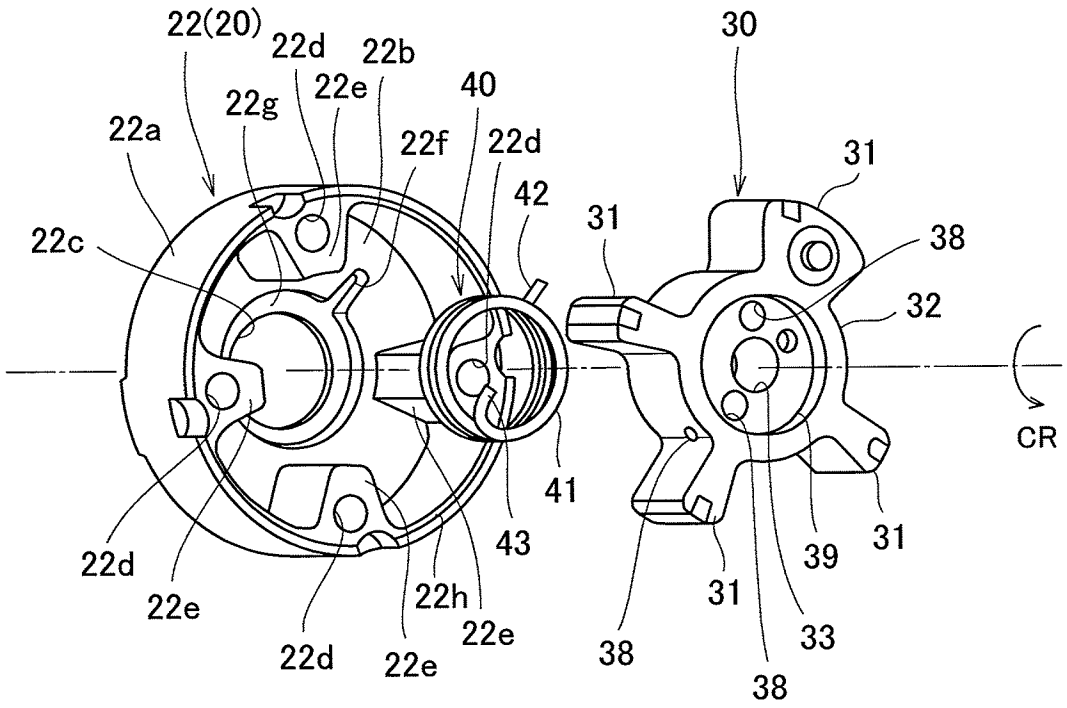
FIG. 4 is an exploded perspective view showing the valve timing varying device of the present invention (viewed from a rear side with omitting a rear side housing member of a housing rotor)
Figure 7:
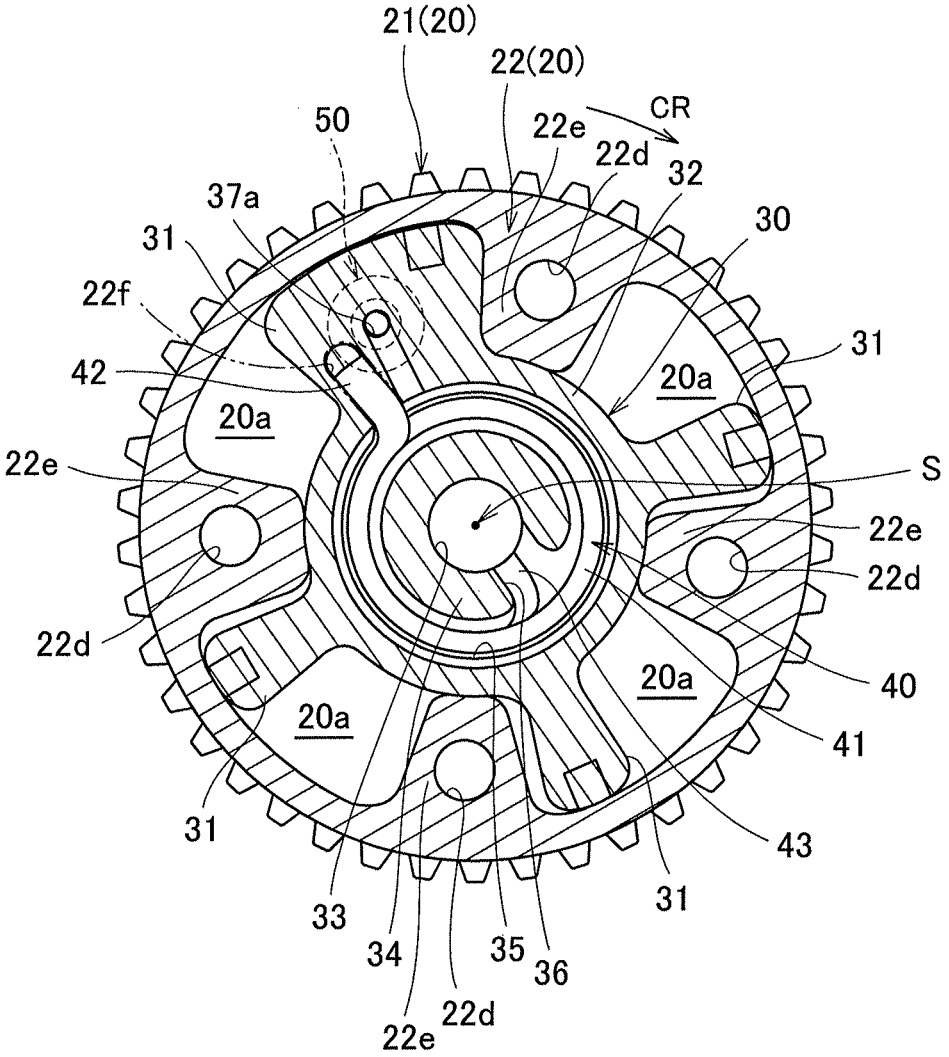
FIG. 7 is a front view showing the situation where the urging spring is accommodated to the vane rotor included in the valve timing varying device of the present invention.
Figure 8:
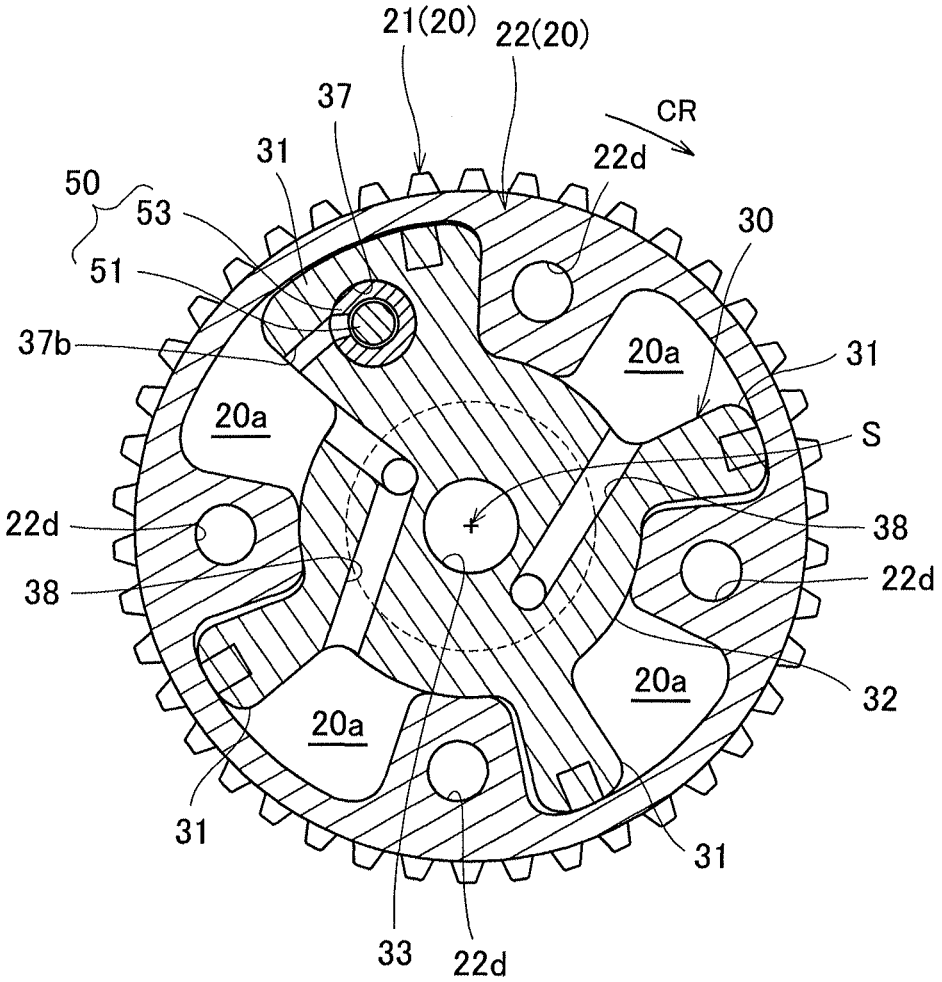
FIG. 8 is across sectional view showing an advanced angle passage communicating with an advanced angle chamber in the condition where the vane rotor as a part of the valve timing varying device of the present invention is located in a most advanced angle position.

Here, the first latching concave part 22*f* is, as shown in FIG. 4 and FIG. 7, formed so as to extend in a direction perpendicular to the rotation axis S.

The vane rotor 30 is, as shown in FIG. 1 to FIG. 5A and FIG. 5B, and FIG. 7 to FIG. 10, four vane part 31, a hub part 32 which integrally holds the four vane parts 31 at equal intervals, a through-hole 33 which is formed on the hub part 32 and though which the bolt 60 is passed, an accommodating concave part 35 which is formed as an annular groove so as to define an annular convex part 34 around the thorough-hole 33 in order to receive at least a part of the coil part 41 of the urging spring 40 on a front end side facing the inside wall face of the front side housing member 22, a second latching concave part 36 which is formed into a groove shape by notching a part of the annular convex part 34 in the radial direction in order to fit and latch the second end 43 of the urging spring 40 in the front end side, a fitting hole 37 into which the lock mechanism 50 (including a lock pin 51, a coil spring 52, and a cylindrical holder 53) is fitted in one of the vane parts 53, a pressure adjusting hole 37*a* which is formed to pierce from the fitting hole 37 to the front end side, an oil passage 37*b* which communicates with the advanced angle chamber 20*a* in order to supply and discharge the hydraulic oil to and from a pressure receiving part of (the lock pin 51 of) the lock mechanism 50, an advanced angle passage 38 which communicates with the advanced angle passage 13 in order to supply and discharge the hydraulic oil to and from the advanced angle chamber 20*a*, a fitting concave part 39 into which the camshaft 10 is fitted, seal members fitted into groove parts formed at tips of the vane parts 31, a positioning hole for fitting a positioning pin of the camshaft 10, thereby being fastened to camshaft 10 by use of the bolt 60 and integrally rotating with the camshaft 10.

Here, the second latching concave part 36 is, as shown in FIG. 5A, FIG. 5B to FIG. 7, formed so as to extend in the direction perpendicular to the rotation axis S.

Further, the second latching concave part 36 is formed into a groove shape by notching a part of the annular convex part 34, and formed into a groove width greater than a wire diameter of the second end 43 of the urging spring 40 in a rotation direction around the rotation axis S.

Thus, since the vane rotor 30 has the accommodating concave part 35 forming an annular groove and the second latching concave part 36 formed into a groove shape by notching a part of the annular convex part 34 on the front end side, the configuration that the urging spring 40 is accommodated and the second end 43 is latched can be obtained only by cutting a part thereof without attaching another component to the vane rotor 30. Further, since the second latching concave part 36 is formed into the groove width greater than the wire diameter of the second end 43, the second end 43 of the urging spring 40 can be easily latched on the second latching concave part 36.

The urging spring 40 is, as shown in FIG. 1 to FIG. 5A and FIG. 5B, a torsional coiled spring which has the coil part 41, the first end 42, and the second end 43, and disposed between the front end face of the vane rotor 30 and the inside wall face of the front side housing member 22 in the interior of the housing rotor 20.

Here, the first end 42 and the second end 43 are formed so as to extend in the direction perpendicular to the rotation axis S. The first end 42 is formed so as to extend from the coil part 41 outward in the radial direction of the coil part 41 (namely, provided on an outer side in the radial direction relative to the coil part 41). The second end 43 is formed so as to extend from the coil part 41 toward a center (the rotation axis S) of the coil part 41 (namely, provided on an inner side in the radial direction relative to the coil part 41) and formed so as to line up along the first end 42 on a straight line passing across the center of the coil part 41.

Further, the second end 43 of the urging spring 40 is formed so as to be directed toward an inside of the coil part 41 in a region facing the opening 22*c* of the front side housing member 22.

And, the coil part 41 is fitted and accommodated in the accommodating concave part 35 of the vane rotor 30, the second end 43 is fitted and latched in the second latching concave part 36 of the vane rotor 30, the first end 42 is fitted and latched in the first latching concave part 22*f* of the front side housing member 22 and the coil part 41 (the front end side) connected to the first end 42 is accommodated in the accommodating concave part 22*g*, whereby the assembly thereof is accomplished.

That is, upon assembling of the urging spring 40, the urging spring 40 and the vane rotor 30 are fitted to the front side housing member 22 such that the urging spring 40 is sandwiched while the first end 42 being latched on the first latching concave part 22*f* of the front side housing member 22, and the front side rejoin of the coil part 41 being fitted in the accommodating concave part 22*g* and the rear side rejoin of the coil part 41 being fitted in the accommodating concave part 35, and the second end 43 is latched on the second latching concave part 36 by use of a predetermined jig and the like with being visible through the opening 22*c* of the front side housing member 22 from the front side in the rotation axis S, whereby the urging spring 40 is assembled while being accommodated in the interior of the housing rotor 20 (between the front side housing member 22 and the vane rotor 30).

In this assembled state, the urging spring 40 is configured to rotation-urge the vane rotor 30 toward the advanced angle direction with respect to the housing rotor 20.

Thus, in the configuration that adopts a two-divided structure consisting of the bottomed cylindrical front side housing member 22 and the rear side housing member 21 as the housing rotor 20, upon assembling of the device, the urging spring 40 and the vane rotor 30 are fitted to the front side housing member 22 such that the urging spring 40 is sandwiched while the first end 42 being latched on the first latching concave part 22*f* of the front side housing member 22 and at least a part of the coil part 41 being fitted in the accommodating concave part 35, and the second end 43 is latched on the second latching concave part 36 of the vane rotor 30 with being visible through the opening 22*c*, whereby the urging spring 40 can be easily assembled while being accommodated in the interior of the housing rotor 20.

And, since the urging spring 40 is arranged between the front side housing member 22 and the vane rotor 30, the distance in the direction of rotation axis S of the camshaft 10 from the center of the vane rotor 30 to the first end 42 of the urging spring 40 can be shortened. Therefore, an inclination (a deviation) (relative to the rotation axis S) of the vane rotor 30 caused by the urging force of the urging spring 40 can be prevented, wear and a friction force in the sliding region of the vane rotor 30 can be reduced, a predetermined function can be assured. Further, the conventional parts such as fixed pins, bushings or the like are not required. Therefore, simplification of the structure, reduction of the number of components, downsizing of the device (thinning in the direction of the rotation axis S), cost reduction and the like can be accomplished.

Further, since all of the first end 42 and the second end 43 of the urging spring 40 and the first latching concave part 22*f* and the second latching concave part 36 are formed so as to extend in the direction perpendicular to the rotation axis S, the device can be further thinned and downsized in the direction of the rotation axis S as compared with the case formed so as to extend in the direction of rotation axis S.

Furthermore, since the second end 43 is formed so as to line up along the first end 42 on a straight line (perpendicular to the rotation axis S) passing across the center (the rotation axis S) of the coil part 41, when the urging spring 40 has been assembled, most balanced assembling condition can be obtained, an inclination or a falling (deviation) of the urging spring 40 can be prevented.

Figure 5A:
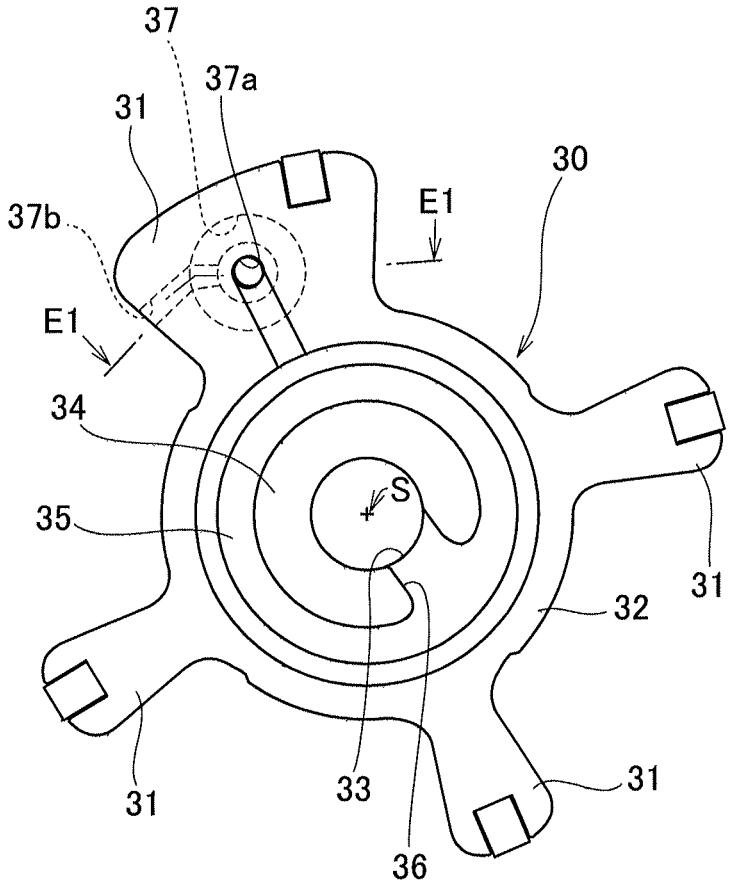
FIG. 5A is a front view showing a vane rotor as a part of the valve timing varying device of the present invention viewed from a front side.
Figure 5B:
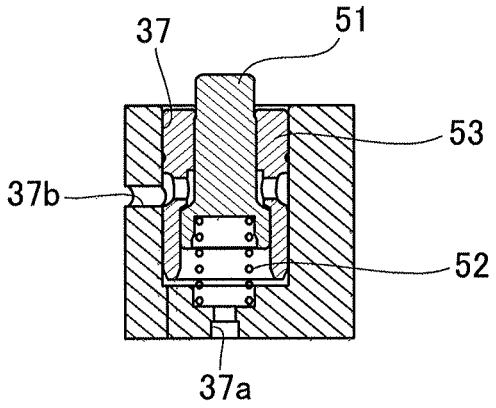
FIG. 5B is a cross sectional view at E1-E1 in FIG. 5A showing the vane rotor as a part of the valve timing varying device of the present invention.

The lock mechanism 50 is, as shown in FIG. 2, FIG. 5A and FIG. 5B, composed of the lock pin 51 that is reciprocatable in the direction of the rotation axis S and capable of protruding from the rear end face of the vane rotor 30, the coil spring 52 for urging the lock pin 51 toward a protruding direction, and the cylindrical holder 53 that is fitted in the fitting hole 37 of the van rotor 30 in order to reciprocatably hold the lock pin 51 urged by the coil spring 52.

In a state where the pressure of the hydraulic oil that is supplied through the oil passages 21*f* and 37*b* and presses the lock pin 51 is low, the lock pin 51 is urged by the coil spring 52 to be fitted in the fitting hole 21*e* of the housing rotor 20 (the rear side housing member 21), whereby the vane rotor 30 is locked in a predetermined position (here, the most advanced angle position θa) within the predetermined angular range Δθ relative to the housing rotor 20, while the pressure of the hydraulic oil that is led through the oil passages 21*f* and 37*b* and presses the lock pin 51 is raised, whereby the lock pin 51 is retracted from the rear end face of the vane rotor 30 to release the lock.

The bolt 60 is, as shown in FIG. 1 and FIG. 2, formed into a solid cylindrical shape, and has a male screw part 61 at a distal end hereof, a flanged head 62 abutting against the annular convex part 34 of the vane rotor 30, and the like.

And, the bolt 60 is inserted into the through-hole 33 through the opening 22*c* of the front side housing member 22 and the male screw part 61 is screwed into the female screw part 15 of the camshaft 10, whereby the vane rotor 30 is integrally fastening-fixed with the camshaft 10.

The hydraulic control system OSC is, as shown in FIG. 1 and FIG. 2, composed of a hydraulic control valve 100 for controlling a flow of the hydraulic oil discharged from a pump, an advanced angle side passage 101 communicating with the hydraulic control valve 100 and the advanced angle passage 13, a retarded angle side passage 102 communicating with the hydraulic control valve 100 and the retarded angle passage 14, a control means (not shown) for controlling the drive of the hydraulic control valve 100, and the like.

Next, a method of assembling the valve timing varying device will be explained.

In advance, the front side housing member 22, the rear side housing member 21, the vane rotor 30 in which the lock mechanism 50 has been incorporated, the urging spring 40, the bolt 60, four bolts B, a predetermined jig, and the like will be prepared.

First, the first end 42 of the urging spring 40 is latched on the first latching concave part 22*f* formed on the inside wall face of the front side housing member 22 and the front side region of the coil part 41 is fitted in the accommodating concave part 22*g*.

Subsequently, the vane rotor 30 is fitted in the front side housing member 22 so as to sandwich the urging spring 40 therebetween while fitting the rear side region of the coil part 41 of the urging spring 40 into the accommodating concave part 35.

Figure 6:
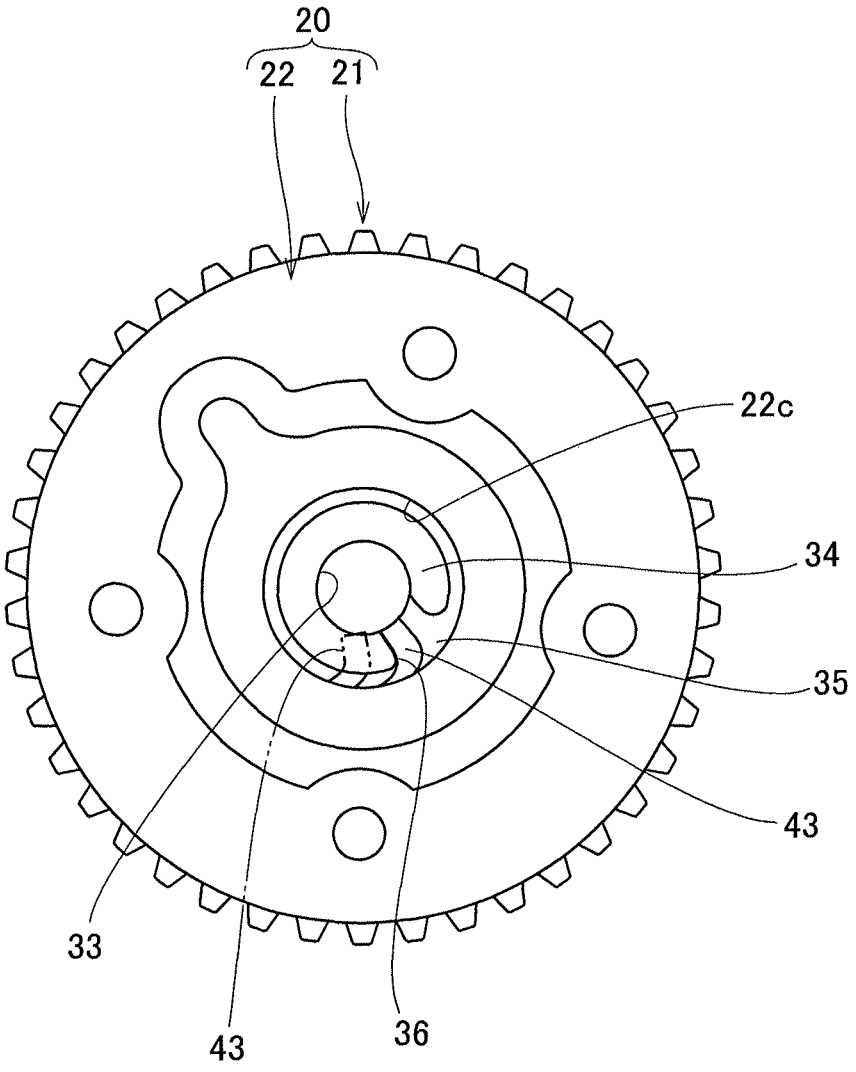
FIG. 6 is a front view viewed from a front side in the direction of the rotation axis and showing the situation where the urging spring and the vane rotor included in the valve timing varying device of the present invention are accommodated to the front side housing member.

Subsequently, as shown in FIG. 6, a predetermined jig is inserted in the through-hole 22*c* from the front side of the front side housing member 22 while viewing the second end 43 and the second latching concave part 36 through the opening 22*c*, and the second end 43 is latched on the second latching concave part 36 (by moved from a position shown by two-dot chain line to a position indicated by solid line by use of the jig).

Here, since the groove width of the second latching concave part 36 is formed larger than the wire diameter of the second end 43, the latching operation can be easily carried out.

And, the vane rotor 30 is further pushed relative to the front side housing member 22, subsequently, the front side housing member 22 in which the urging spring 40 and the vane rotor 30 have been incorporated is opposed and abut to the rear side housing member 21 and then fastened and fixed by using the bolts B.

As a result, the assembly of the device (the housing rotor 20, the vane rotor 30, the urging spring 40, and the lock mechanism 50) is completed.

Thereafter, adequately, (the rear side housing member 21 of) the housing rotor 20 is rotatably fitted into the camshaft 10 of the engine and the fitting concave part 39 of the vane rotor 30 is joined with the front end side of the camshaft 10.

And, the bolt 60 is screwed in the female screw part 15 of the camshaft 10 by passed thorough the opening 22*c* of the front side housing member 22 and the through-hole 33, whereby the vane rotor 30 is fastened and fixed to the camshaft 10 so as to rotate integrally.

As a result, the assembly of the valve timing varying device and the assembly of the assembled device with respect to the camshaft (of a predetermined engine) are completed.

Thus, in the configuration that adopts a two-divided structure consisting of the bottomed cylindrical front side housing member 22 and the rear side housing member 21 as the housing rotor 20, upon assembling of the device, the urging spring 40 and the vane rotor 30 are fitted to the front side housing member 22 such that the urging spring 40 is sandwiched while the first end 42 being latched on the first latching concave part 22*f* of the front side housing member 22, and the second end 43 is latched on the second latching concave part 36 by use of a predetermined jig with being visible through the opening 22*c*, whereby the urging spring 40 can be easily assembled while being accommodated in the interior of the housing rotor 20.

Here, since at least a part of the coil part 41 of the urging spring 40 is fitted in the accommodating concave part 35 formed on the front end side of the vane rotor 30 facing the inside wall face of the front side housing member 22, and the coil part 41 connected to the first end 42 of the urging spring 40 is fitted to the accommodating concave part 22*f* formed on the inside wall face of the front side housing member 20 facing the vane rotor 30, upon assembling each among of the front side housing member 22, the urging spring 40, and the vane rotor 30, the urging spring 40 can be easily accommodated while preventing a positional displacement (deviation) of the urging spring 40.

In addition, in the above-described assembling method, it is shown that the coil part 41 of the urging spring 40 is fitted in the accommodating concave part 22*g* of the front side housing member 22 and the accommodating concave part 35 of the vane rotor 30, but the method is not limited thereto, it may be a way that simply, the first end 42 of the urging spring 40 is latched on the first latching concave part 22*f* of the front side housing member 22, and the second end 43 of the urging spring 40 is latched on the second latching concave part 36 of the vane rotor 30.

Next, an operation of the valve timing varying device will be explained with reference to FIG. 2, FIG. 9, and FIG. 10.

Figure 9:
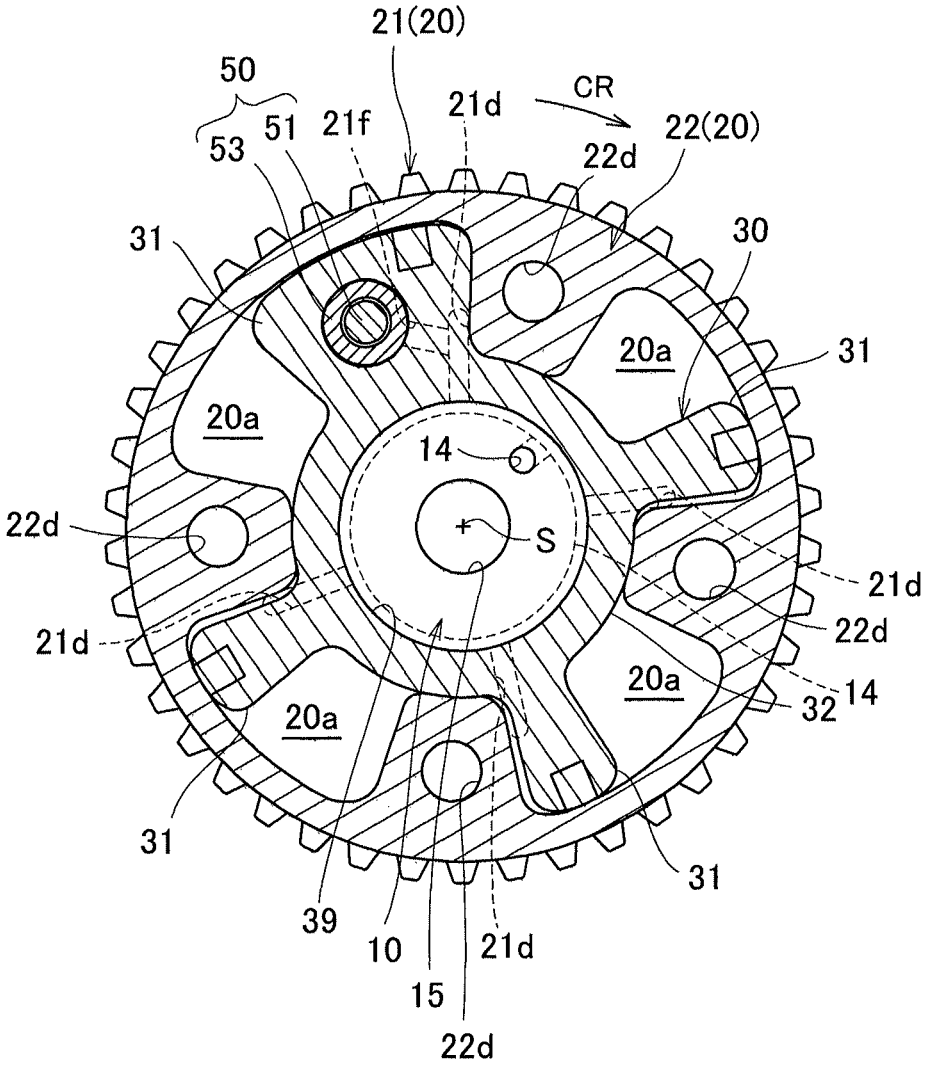
FIG. 9 is across sectional view showing an retarded angle passage communicating with an retarded angle chamber in the condition where the vane rotor as a part of the valve timing varying device of the present invention is located in a most advanced angle position.

In a state where the engine is stopped, as shown in FIG. 2 and FIG. 9, the hydraulic oil is discharged from the advanced angle chamber 20*a* and the retarded angle chamber 20*b*, the vane rotor 30 is positioned in the most advanced angle position θa by the urging force of the urging spring 40, and the lock pin 51 of the lock mechanism 50 is fitted into the fitting hole 21*e*, whereby the vane rotor 30 is in a state where the vane rotor 30 has been locked with respect to the housing rotor 20.

Thus, at the timing of starting the engine, it is possible to start the engine smoothly while preventing the flutter or the like of the vane rotor 30.

Subsequently, by starting of the engine, the hydraulic oil is supplied to the pressure receiving part of the lock pin 51 through the oil passage 37*b* (or the oil passage 21*f*), and then the lock pin 51 is pressed by the oil pressure of the hydraulic oil to separate from the fitting hole 21*e* and therefore, the lock state is released.

Then, after the starting of the engine, the hydraulic control valve 100 is shifted appropriately, a phase control is performed such that the vane rotor 30 (the camshaft 10) is shifted toward the retarded angle side (retarded angle mode) or the advanced angle side (advanced angle mode) and further is held in a predetermined angle position (hold mode).

Figure 10:
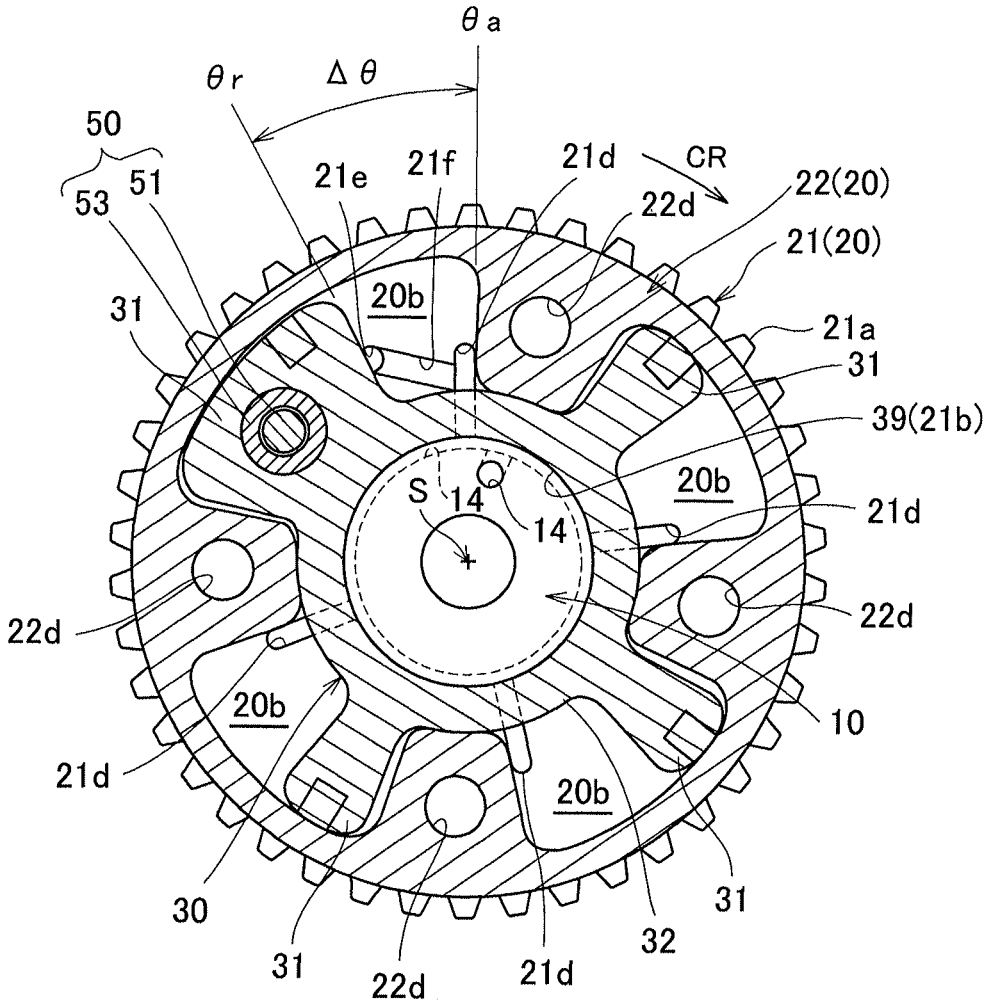
FIG. 10 is a cross sectional view showing an retarded angle passage communicating with an retarded angle chamber in the condition where the vane rotor as a part of the valve timing varying device of the present invention is located in a most retarded angle position.

For example, in the case of the retarded angle mode, the hydraulic oil is discharged from the advanced angle chamber 20*a* via the advanced angle passage 13 and the advanced angle side passage 101, and the hydraulic oil is supplied to the retarded angle chamber 20*b* via the retarded angle passage 14 and the retarded angle side passage 102, whereby the vane rotor 30 is, as shown in FIG. 10, rotated counterclockwise (toward the retarded angle side) with respect to the housing rotor 20 by the oil pressure of the hydraulic oil while resisting the urging force of the urging spring 40.

Further, in the case of the advanced angle mode, the hydraulic oil is discharged from the retarded angle chamber 20*b* via the retarded angle passage 14 and the retarded angle side passage 102, and the hydraulic oil is supplied to the advanced angle chamber 20*a* via the advanced angle passage 13 and the advanced angle side passage 101, whereby the vane rotor 30 is, as shown in FIG. 9, rotated clockwise (toward the advanced angle side) with respect to the housing rotor 20 by the oil pressure of the hydraulic oil and the urging force of the urging spring 40.

Furthermore, in the case of the hold mode where the vane rotor 30 is held in a middle position between the most advanced angle position θa and the most retarded position θr, the hydraulic pressure control valve 100 is shifted and then, the hydraulic oil is supplied to the advanced angle chamber 20*a* and the retarded angle chamber 20*b*, whereby the vane rotor 30 is held in the predetermined middle position by the pressure of the hydraulic oil acting on the advanced angle chamber 20*a* and the retarded angle chamber 20*b*.

According to the above-described valve timing varying device, the urging spring is disposed inside the housing rotor 20, the coil part 41 is accommodated in the accommodating concave part 35 of the vane rotor 30, the first end 42 is fitted in and latched on the first latching concave part 22*f*, and the second end 43 is fitted in and latched on the second latching concave part 36 of the vane rotor 30 by using a predetermined jig inserted from the opening 22*c*, whereby the urging spring 40 can be easily assembled while being accommodated inside the housing rotor 20, the distance in the direction of rotation axis S of the camshaft 10 from the center of the vane rotor 30 to the first end 42 of the urging spring 40 can be shortened, and the inclination (or the falling) (relative to the rotation axis S) of the vane rotor 30 caused by the urging force of the urging spring 40 can be prevented.

Therefore, wear and a friction force in the sliding area of the vane rotor 30 can be reduced, a predetermined function can be assured, and the conventional parts such as fixed pins, bushings or the like are not required, simplification of the structure, reduction of the number of components, downsizing of the device (thinning in the direction of the rotation axis S), cost reduction and the like can be accomplished.

In the above-described embodiment, although the housing rotor 20 with the sprocket 21 is shown as a driven part for transmitting a rotational force of the crankshaft, it is not limited thereto, and in case that a transmitting means for transmitting the rotational driving force of the crankshaft has other structures (for example, a toothed timing belt and the like), a housing rotor with one (for example, a toothed pulley and the like) that suits those structures can be adopted.

In the above-described embodiment, as the lock mechanism, although the configuration that includes the lock pin 51, the coil spring 52, and the cylindrical holder 53 and locks in the most advanced angle position, it is not limited thereto, as long as a configuration that can lock the vane rotor 30 relative to the housing rotor 20, other lock mechanism can be adopted, and a locked position is not limited to the most advanced angle position, other positions may be adopted according as a need.

In the above-described embodiment, although the case that the first end 42 and the second end 43 of the urging spring 40 are formed so as to extend in the direction perpendicular to the rotation axis S, and the first latching concave part 22*f* and the second latching concave part 36 are formed so as to extend in the direction perpendicular to the rotation axis S is shown, it is not limited thereto, as long as a configuration that the urging spring is disposed between the inside wall face of the housing rotor 20 and the front end face of the vane rotor and the second end is formed in the area facing the opening 22*c* of the front side housing member 22, the first end and the second end may be formed so as to extend in other direction and the first latching concave part and the second latching concave part may are formed so as to extend in the same direction as the other direction.

INDUSTRIAL APPLICABILITY

As described above, according to the valve timing varying device of the present invention, an inclination of the vane rotor can be prevented, wear and a friction force in a sliding area can be reduced, a predetermined function can be assured, and the assembling can be easily performed while achieving simplification of the structure, reduction of the number of components, downsizing of the device (thinning in the direction of the rotation axis), cost reduction and the like and therefore, the device can be applied, of course, to an internal combustion engine of an automobile and the like, and it is also useful in small engine and the like mounted on a motorcycle and the like.

EXPLANATION OF REFERENCES

S1 rotation axis
10 camshaft
11 journal part
12 cylindrical part
13 advanced angle passage
14 retarded angle passage
15 female screw part
20 housing rotor
21 rear side housing member
21*a* sprocket
21*b* inner circumferential face
21*c* front face (inside wall face)
21*d* retarded angle passage
21*e* fitting hole
21*f* oil passage
21*g* screw hole
22 front side housing member
22*a* cylindrical wall
22*b* front wall
22*c* opening
22*d* though-hole
22*e* shoe part
22*f* first latching concave part
22*g* accommodating concave part
22*h* annular joint part
30 vane rotor
31 vane part
32 hub part
33 through-hole
34 annular convex part
35 accommodating concave part
36 second latching concave part
37 fitting hole
37*a* pressure adjusting hole
37*b* oil passage
38 advanced angle passage
39 fitting concave part
40 urging spring
41 coil part
42 first end
43 second end
50 lock mechanism
51 lock pin
52 coil spring
53 cylindrical holder
60 bolt

61 male screw part
62 flanged head
B bolt
OCS hydraulic control system
100 hydraulic control valve
101 advanced angle side passage
102 retarded angle side passage
Δθ predetermined angle range
θa most advanced angle position
θr most retarded angle position

The invention claimed is:

1. A valve timing varying device that varies an opening and closing timing of an intake valve or an exhaust valve driven so as to open and close via a camshaft by controlling an oil pressure in an advanced angle chamber and a retarded angle chamber, the valve timing varying device comprising:

a housing rotor rotated on a rotation axis of the camshaft in synchronism with rotation of a crankshaft;

a vane rotor rotated integrally with the camshaft and accommodated in an accommodating chamber of the housing rotor so as to relatively rotate within a predetermined angle range to divide the accommodating chamber into the advanced angle chamber and the retarded angle chamber; and a torsional coiled urging spring for urging the vane rotor toward one rotation direction relative to the housing rotor, wherein the housing rotor is composed of a bottomed cylindrical front side housing member having an opening though which a bolt for fastening the vane rotor to the camshaft is inserted from a front side, and a rear side housing member joined with the front side housing member, the urging spring has a coil part, a first end provided outside in a radial direction with respect to the coil part, and a second end provided inside in the radial direction with respect to the coil part, the front side housing member has a first latching concave part for receiving and latching the first end of the urging spring on an inside wall face facing the vane rotor, and the vane rotor has an accommodating concave part for receiving at least a part of the coil part of the urging spring on a front end side facing an inside wall face of the front side housing member, and a second latching concave part for receiving and latching the second end of the urging spring in an area facing the opening on the front side end, the second latching concave part being visible though the opening.

2. The valve timing varying device according to claim 1, wherein the front side housing member has an accommodating concave part for accommodating the coil part connected to the first end of the urging spring on the inside wall face facing the vane rotor.

3. The valve timing varying device according to claim 1, wherein the first end and the second end of the urging spring are formed so as to extend in a direction perpendicular to the rotation axis of the camshaft, and the first latching concave part and the second latching concave part are formed so as to extend in the direction perpendicular to the rotation axis of the camshaft.

4. The valve timing varying device according to claim 3, wherein the second end of the urging spring is formed so as to line up along the first end on a straight line passing across a center of the coil part.

5. The valve timing varying device according to claim 1, wherein the vane rotor has a thorough-hole for passing through a bolt fastened to the camshaft, the accommodating concave part of the vane rotor is formed into an annular groove so as to define an annular convex part around the through-hole, and the second latching concave part is formed into a groove shape by notching a part of the annular convex part and formed into a groove width greater than a wire diameter of the second end of the urging spring in a rotation direction around the rotation axis.

6. The valve timing varying device according to claim 1, further comprising:

a lock mechanism for locking the vane rotor in a predetermined position within a predetermined angle range relative to the housing rotor and unlocking the vane rotor by an oil pressure, wherein the lock mechanism includes a lock pin that is reciprocatable in a direction of the rotation axis and held by the vane rotor while being urged so as to protrude from a rear end face of the vane rotor and that is configured to be fitted in a fitting hole formed on an inside wall face of the rear side housing member in the predetermined position.

7. A method of assembling a valve timing varying device that varies an opening and closing timing of an intake valve or an exhaust valve driven so as to open and close via a camshaft by controlling an oil pressure in an advanced angle chamber and a retarded angle chamber, and that includes: a housing rotor rotated on a rotation axis of the camshaft in synchronism with rotation of a crankshaft; a vane rotor rotated integrally with the camshaft and accommodated in an accommodating chamber of the housing rotor so as to relatively rotate within a predetermined angle range to divide the accommodating chamber into the advanced angle chamber and the retarded angle chamber; and a torsional coiled urging spring for urging the vane rotor toward one rotation direction relative to the housing rotor, the housing rotor being composed of a bottomed cylindrical front side housing member having an opening though which a bolt for fastening the vane rotor to the camshaft is inserted from a front side, and a rear side housing member joined with the front side housing member, fitting the urging spring and the vane rotor to the front side housing member such that the urging spring is sandwiched while a first end of the urging spring is latched on a first latching concave part formed on an inside wall face of the front side housing member, inserting a predetermined jig through the opening of the front side housing member, and latching a second end of the urging spring by using the jig on a second latching concave part that is formed on a front end side of the vane rotor facing the inside wall face of the front side housing member in an area facing the opening and that is visible though the opening.

8. The method of assembling a valve timing varying device according to claim 7, wherein at least a part of a coil part of the urging spring is fitted in an accommodating concave part formed on a front end side of the vane rotor facing the inside wall face of the front side housing member.

9. The method of assembling a valve timing varying device according to claim 7, wherein the coil part connected to the first end of the urging spring is fitted to an accommodating concave part formed on the inside wall face of the front side housing member facing the vane rotor.

* * * * *